US007500927B2

(12) United States Patent
Morshed et al.

(10) Patent No.: US 7,500,927 B2
(45) **Date of Patent: *Mar. 10, 2009**

(54) TENNIS BALL DELIVERY DEVICE

(76) Inventors: Hadi Morshed, 935 Napoli Dr., Pacific Palisades, CA (US) 90272; Nicholas A. Morshed, 935 Napoli Dr., Pacific Palisades, CA (US) 90272

( * ) Notice: Subject to any disclaimer, the term of this patent is extended or adjusted under 35 U.S.C. 154(b) by 0 days.

This patent is subject to a terminal disclaimer.

(21) Appl. No.: 11/557,470

(22) Filed: Nov. 7, 2006

(65) Prior Publication Data

US 2007/0087867 A1 Apr. 19, 2007

Related U.S. Application Data

(63) Continuation-in-part of application No. 11/363,894, filed on Feb. 28, 2006, now Pat. No. 7,244,198.

(60) Provisional application No. 60/657,952, filed on Mar. 2, 2005.

(51) Int. Cl.
*A63B 69/38* (2006.01)

(52) U.S. Cl. ..... 473/459

(58) Field of Classification Search ..... 473/459, 473/473, 422, 474; 124/49, 50
See application file for complete search history.

(56) References Cited

U.S. PATENT DOCUMENTS 4,021,036 A * 5/1977 Nelson et al. ..... 473/459
4,538,810 A * 9/1985 Brophy ..... 124/7
4,548,407 A * 10/1985 Sato ..... 124/7
4,676,504 A * 6/1987 Ponza ..... 124/7
5,042,802 A * 8/1991 Depianta ..... 124/50
5,097,985 A * 3/1992 Jones ..... 221/86
5,292,119 A * 3/1994 Norcross ..... 473/451
5,520,397 A * 5/1996 Thompson ..... 473/459
6,176,230 B1 * 1/2001 Thompson ..... 124/16
7,001,289 B1 * 2/2006 Polega ..... 473/459
7,244,198 B2 * 7/2007 Morshed et al. ..... 473/459
2006/0196488 A1 * 9/2006 Morshed et al. ..... 124/49

FOREIGN PATENT DOCUMENTS

DE 41 20 063 A1 * 12/1991

* cited by examiner

*Primary Examiner*—Raleigh W. Chiu
(74) *Attorney, Agent, or Firm*—Sandra P. Thompson; Buchalter Nemer

(57) ABSTRACT

A tennis ball delivery device for use in practicing one's tennis stroke. The device includes an adjustable, moveable frame, a tennis ball carrier assembly comprising an array of ball delivery conduits carried between an upper carrier section and a lower carrier section, a ball discharge chute carried by the lower carrier section, and a rotating ball release mechanism that incrementally rotates and aligns with the next successive ball delivery conduit each time it is activated by an actuating mechanism. The actuating mechanism is positioned and configured to be struck by the player's tennis racket to activate the ball release mechanism.

34 Claims, 8 Drawing Sheets

TENNIS BALL DELIVERY DEVICE

CROSS-REFERENCE TO RELATED APPLICATIONS

This application is a continuation-in-part application of U.S. patent application Ser. No. 11/363,894, filed Feb. 28, 2006, entitled Tennis Ball Delivery Device which application claims priority of U.S. Provisional Application Ser. No. 60/657,952, filed Mar. 2, 2005.

BACKGROUND OF THE INVENTION

The present invention relates to a tennis ball delivery device and, more particularly, to a low cost, readily producible and easily portable device for picking up and holding a supply of tennis balls that, upon actuation by a player, will deliver a ball to the player for practicing his or her tennis stroke. While a wide variety of practice devices are presently available to tennis players for developing their strokes, they typically comprise devices that drive or shoot a ball over the net toward the player who then returns the ball using a backhand or forehand stroke. The proper tennis strokes and footwork are developed through repetitive practice. Such practice devices are relatively large and heavy and hence not easily portable which limits their use. They also require electricity and are relatively expensive, particularly for children in poor families and for people in general in less affluent countries who wish to learn the game of tennis. Because of the size and weight of such devices, they also are not easily used for practice by children and older players without assistance. Without a ball delivery device, a player or prospective player can only practice his or her strokes with a coach, which is very expensive, by hitting a ball against a wall, which generally does not provide repetitive practice of the same stroke, particularly for a novice, or by repetitively dropping a ball on the same spot and at the same height. By having to drop the ball and then turn and strike the ball, the player cannot focus on the proper body position prior to and during the stroke. Also, learning through repetition is impaired because the player has to continually leave his or her position to retrieve another ball. As a result, the rhythm of repetitive practice is lost.

It therefore would be desirable to provide a device that enabled one to practice his or her tennis stroke without the aid of another person, that obviated the need to repetitively retrieve balls, that was of simple construction so as to be economical to manufacture, and that was light in weight and easily portable. Such a device should also be capable of delivering the ball to the player at predetermined variable heights to accommodate differently sized players and to enable the players to practice different strokes. Such a device would not only be beneficial to all players but be affordable by a large group of potential tennis players who cannot afford the ball delivery devices currently in use. Such a device also could be used by persons unable to physically transport and set up the tennis delivery ball devices currently available. The present invention provides such a device.

SUMMARY OF THE INVENTION

Briefly, the present invention comprises a tennis ball delivery device for use in practicing one's tennis stroke that obviates the need to retrieve a new ball after each stroke, is very economical to manufacture and is readily portable. The device picks up and carries a supply of tennis balls and, upon activation, drops a single ball from a selected and variable elevation so that the ball will bounce to a desired height where it can be struck by the player using either a forehand or a backhand stroke. In one embodiment, the device comprises an adjustable and collapsible wheeled frame assembly, a plurality of vertically oriented ball delivery conduits radially arranged and carried between an upper section and lower section of a ball carrier assembly, a rotating ball release mechanism carried by the ball carrier assembly centrally located just below the radially arranged ball delivery conduits, an activating mechanism for activating the release mechanism, and a chute located beneath the ball release mechanism for directing the discharged ball toward the user. The activating mechanism preferably employs a depending handle that can be easily pushed by the player with his or her racket so as to effect the release of a single ball from one of the ball delivery conduits such that the ball can fall to the ground, bounce upwardly and be struck by the player. The release mechanism includes a stop to prevent more than one ball from falling from the ball delivery conduits with each movement of the handle.

These and other objects and advantages of the present invention will become readily apparent from the following detailed description taken in conjunction with the accompanying drawings.

DETAILED DESCRIPTION OF THE PREFERRED EMBODIMENT

Figure 1:
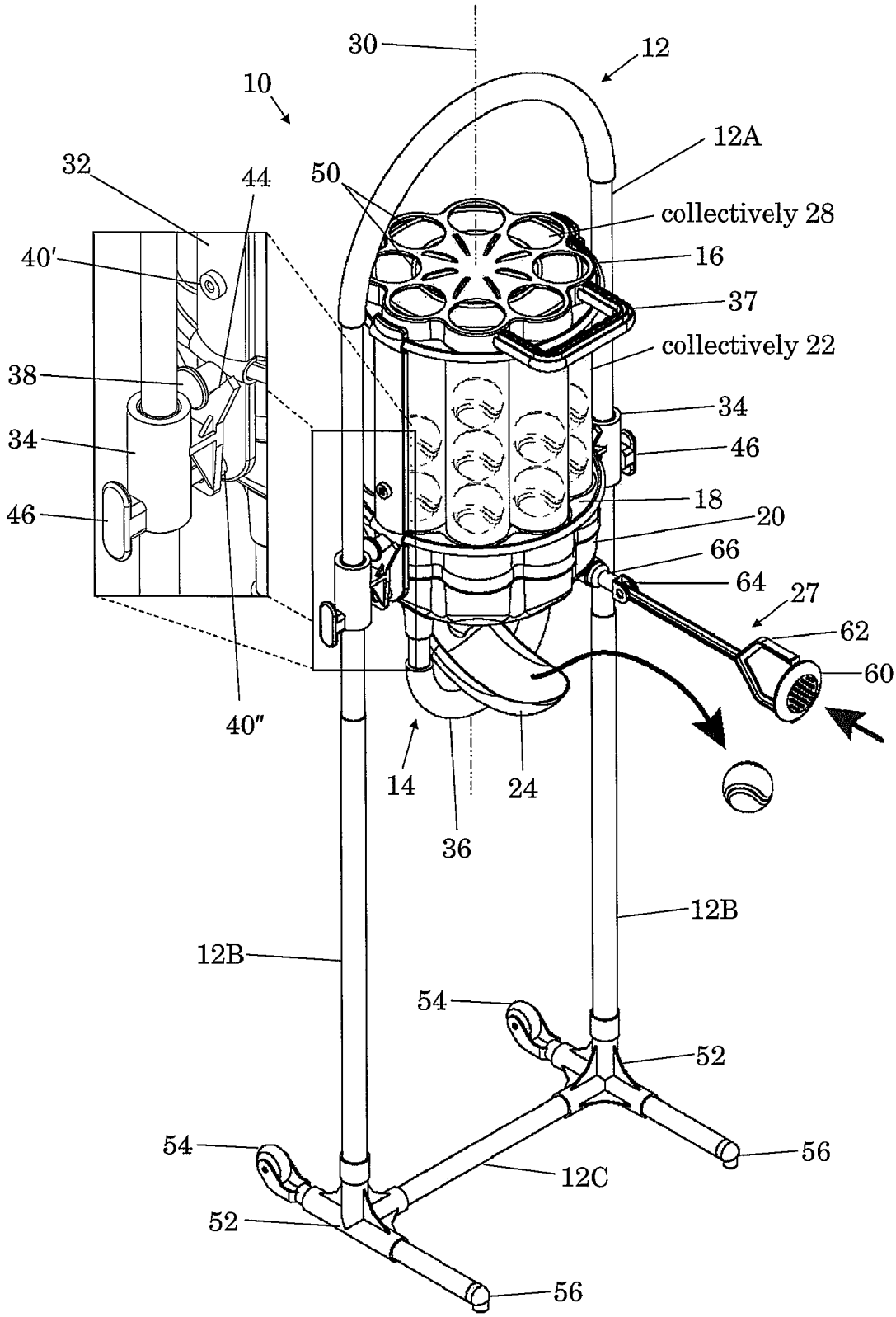
FIG. 1 is a perspective view of an embodiment of the tennis ball delivery device of the present invention illustrating the ball delivery device of the present invention in an extended ball delivery orientation with a portion thereof enlarged for clarity.

The tennis ball delivery device 10 of the present invention includes a frame 12 that is preferably adjustable and collapsible and a tennis ball carrier assembly 14. In the embodiment of the tennis ball delivery device 10 illustrated in FIGS. 1-8, the tennis ball carrier assembly 14 is comprised of lower carrier section 20 affixed to middle carrier section 18, a plurality of vertically disposed ball delivery conduits 22 carried between upper carrier section 16 and middle carrier section 18, a ball release mechanism 26 centrally carried by middle carrier section 18, activating mechanism 27 carried by lower carrier section 20, and a ball discharge chute 24 affixed to lower carrier section 20. It is to be understood that the lower carrier section 20 and the middle carrier section 18 are separate components in the embodiments illustrated in FIGS. 1-8, but could be combined to be a single component.

The ball release mechanism 26 allows for the release of one tennis ball from the array of ball delivery conduits 22 each time the ball release mechanism 26 is activated by activating mechanism 27. The ball delivery conduits 22 are preferably formed so that a tennis ball can roll downwardly through each of the ball delivery conduits 22 without obstruction after the tennis balls are inserted through holes 28 in upper carrier section 16. While a variety of differently configured and/or oriented ball delivery conduits could be employed in the present invention, in the illustrated embodiment, the ball delivery conduits 22 are arranged radially equidistant about the centerline 30 that is at the approximate center of the lower carrier section 20, middle carrier section 18, and the upper carrier section 16. As illustrated most clearly in FIG. 3, the ball discharge chute 24 is affixed to lower carrier section 20 by means of tabs 58 and bolts, screws, or other suitable fasteners 59.

Figure 3:
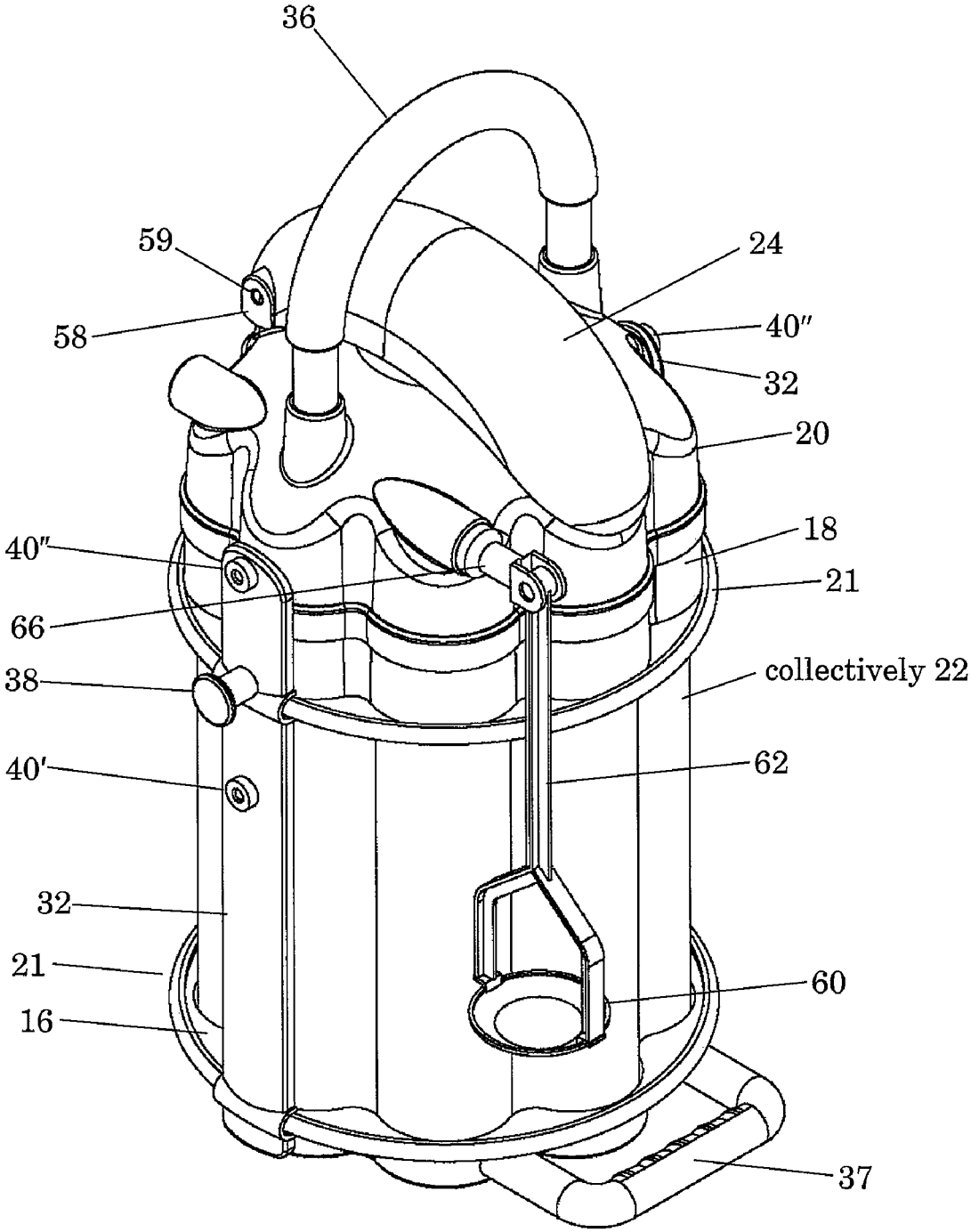
FIG. 3 is a perspective view of an embodiment of the tennis ball carrier assembly of the present invention illustrating the tennis ball carrier assembly in its ball collection orientation.
Figure 4:
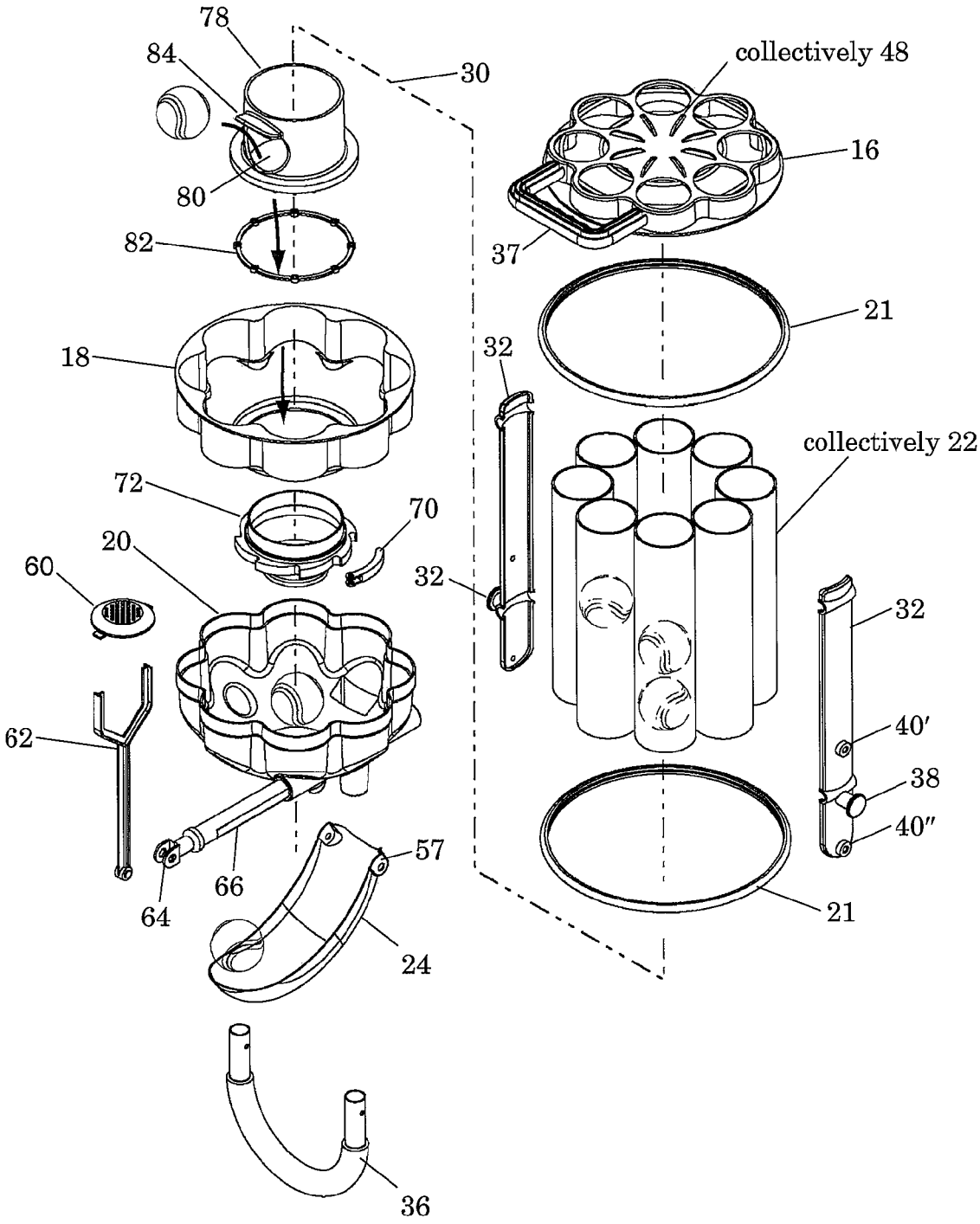
FIG. 4 is an exploded perspective view of an embodiment of the tennis ball carrier assembly of the present invention.
Figure 5:
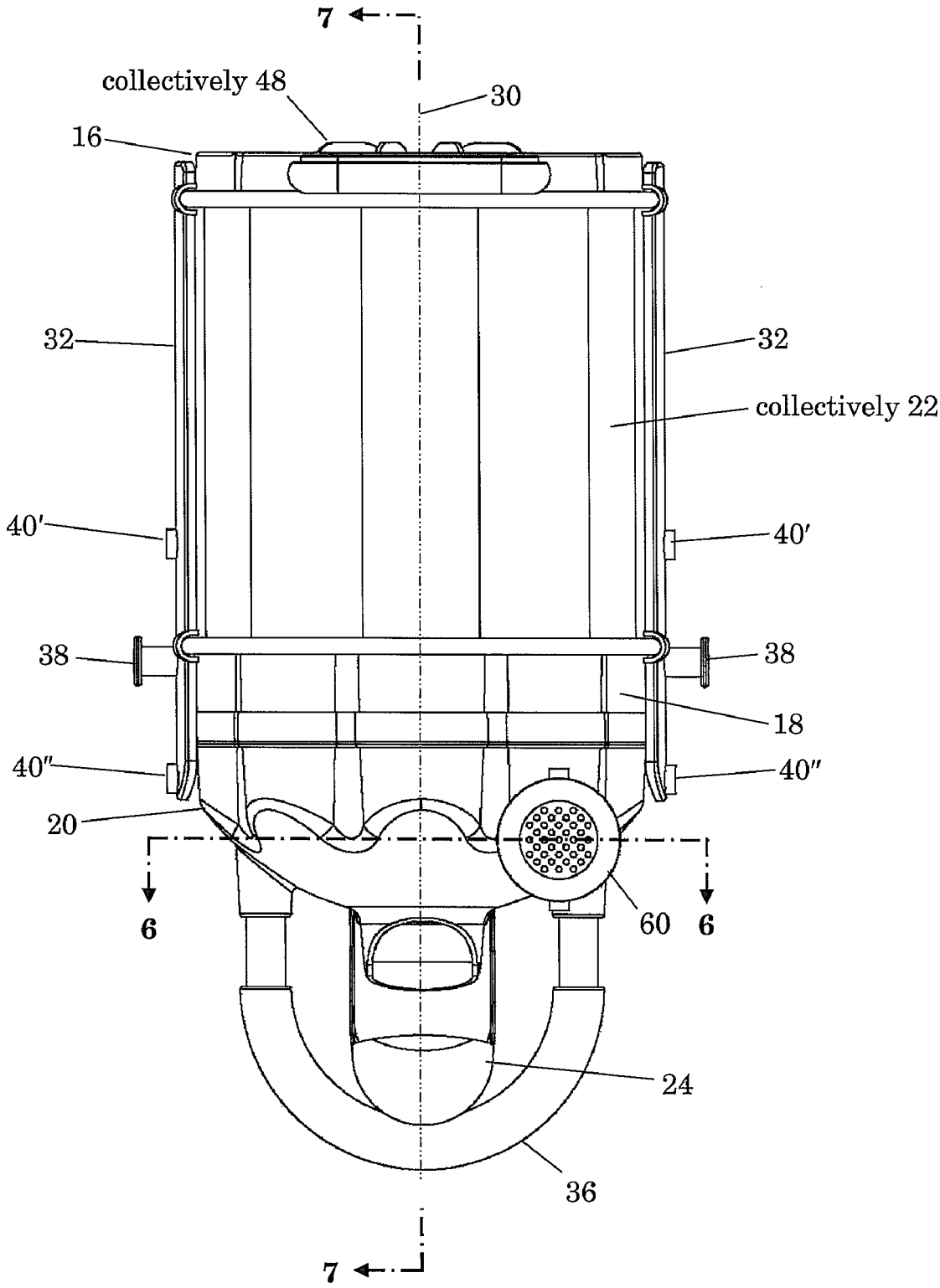
FIG. 5 is a front plan view of an embodiment of the tennis ball carrier assembly of the present invention in the ball delivery orientation.
Figure 6:
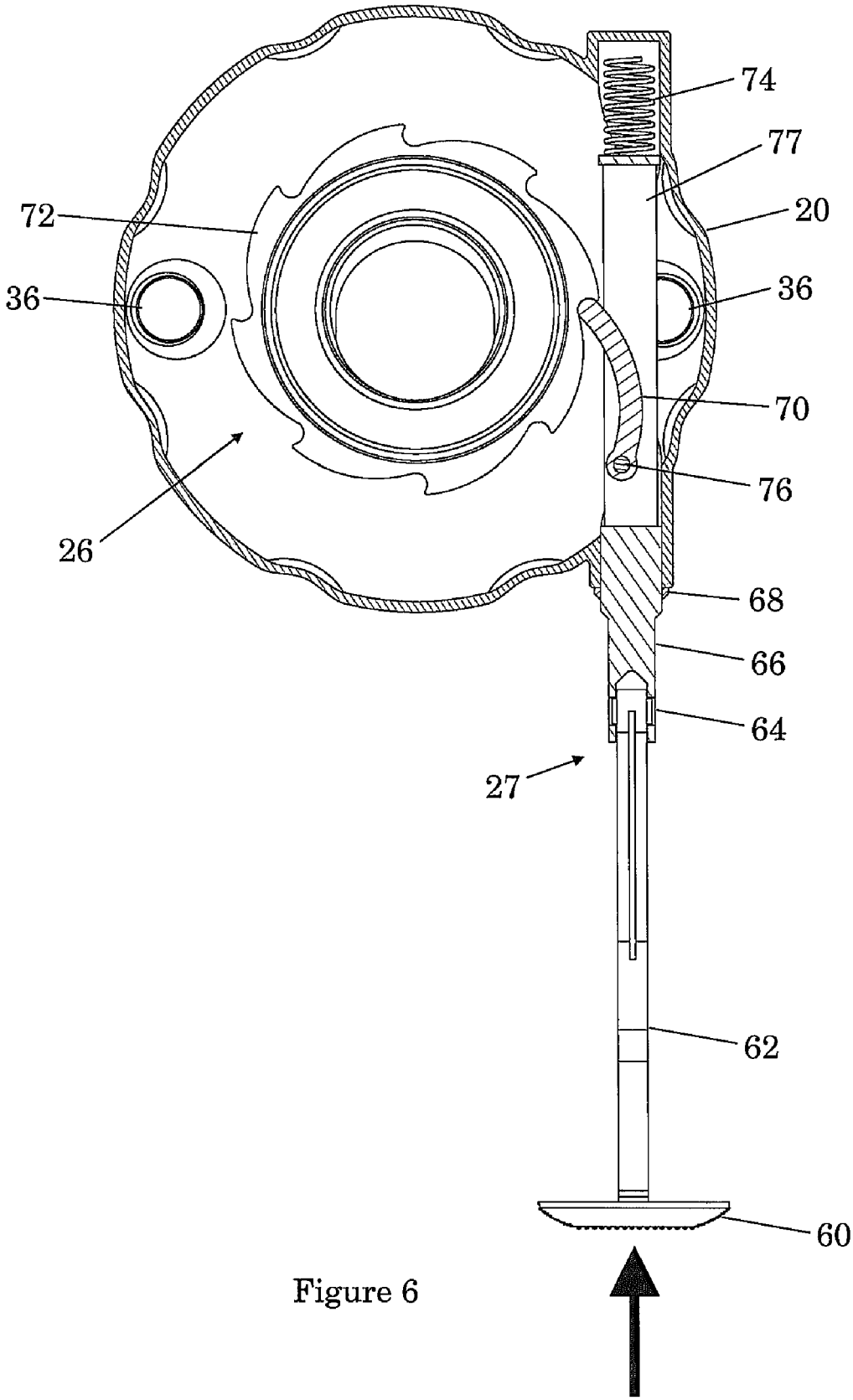
FIG. 6 is a sectional view taken along the line 6-6 of FIG. 5.
Figure 7:
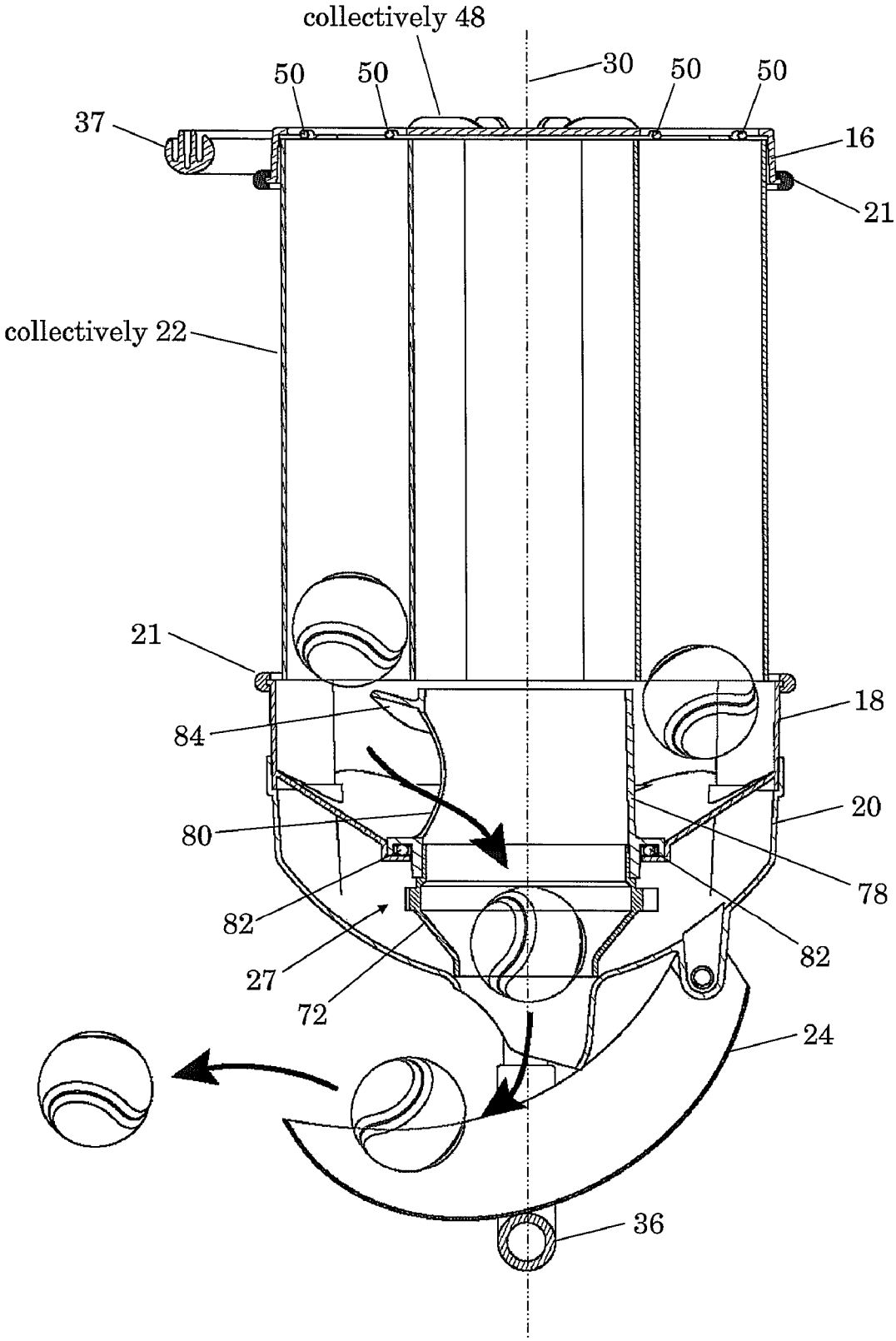
FIG. 7 is a sectional view taken along the line 7-7 of FIG. 5.
Figure 8:
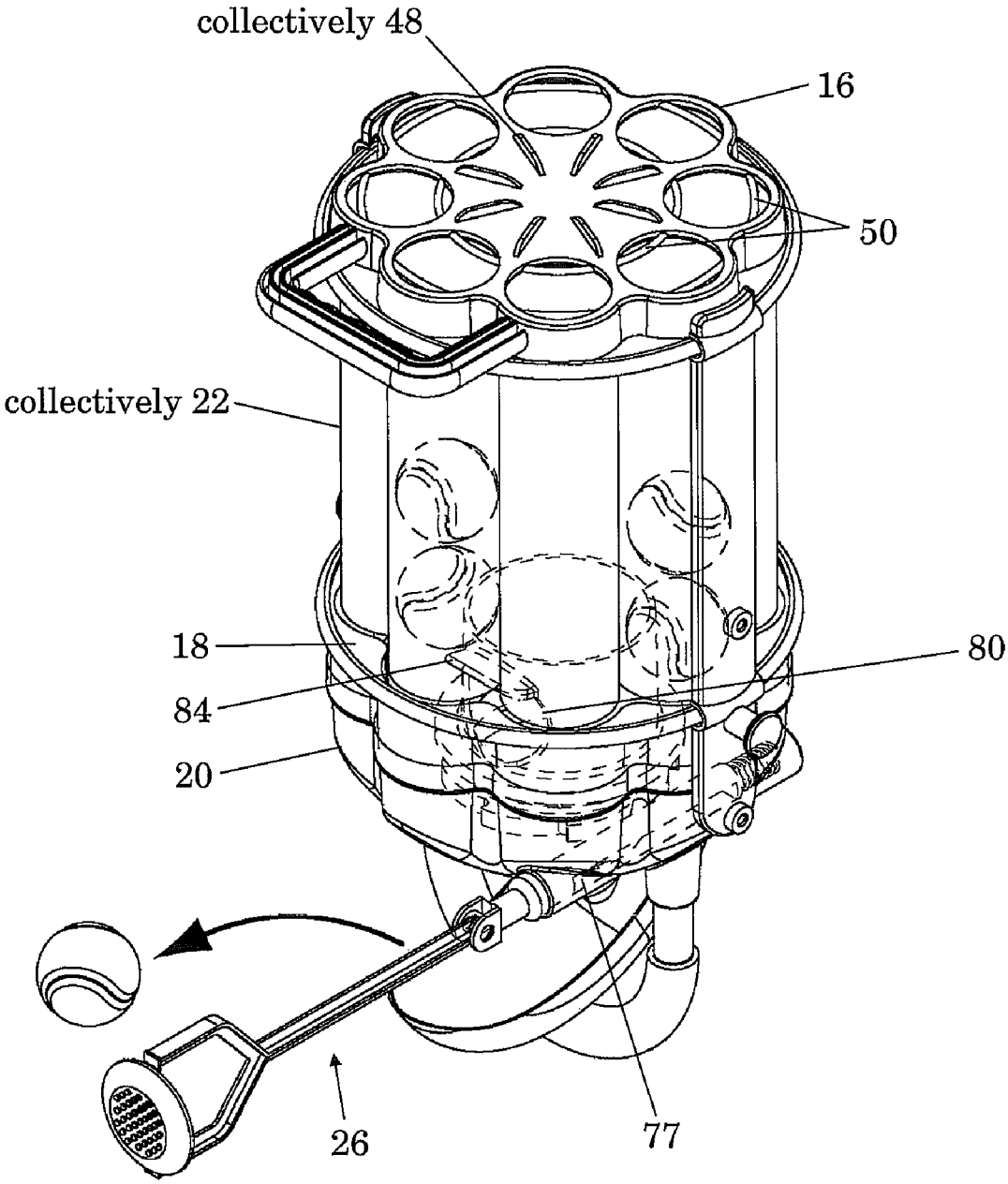
FIG. 8 is a perspective view of the tennis ball carrier assembly of the present invention illustrating the tennis ball carrier assembly delivering a ball.

The lower carrier section 20, middle carrier section 18, ball delivery conduits 22, and upper carrier section 16 can be fastened together using screws, bolts, adhesive, welds, or any other suitable fastening means. As illustrated in FIGS. 3, 4, and 7, protective rings 21 are preferably affixed to upper and middle carrier sections 16 and 18 to protect the tennis ball carrier assembly 14 from impact damage. The protective rings 21 may be formed of a soft, resilient material, such as rubber or neoprene.

Figure 2:
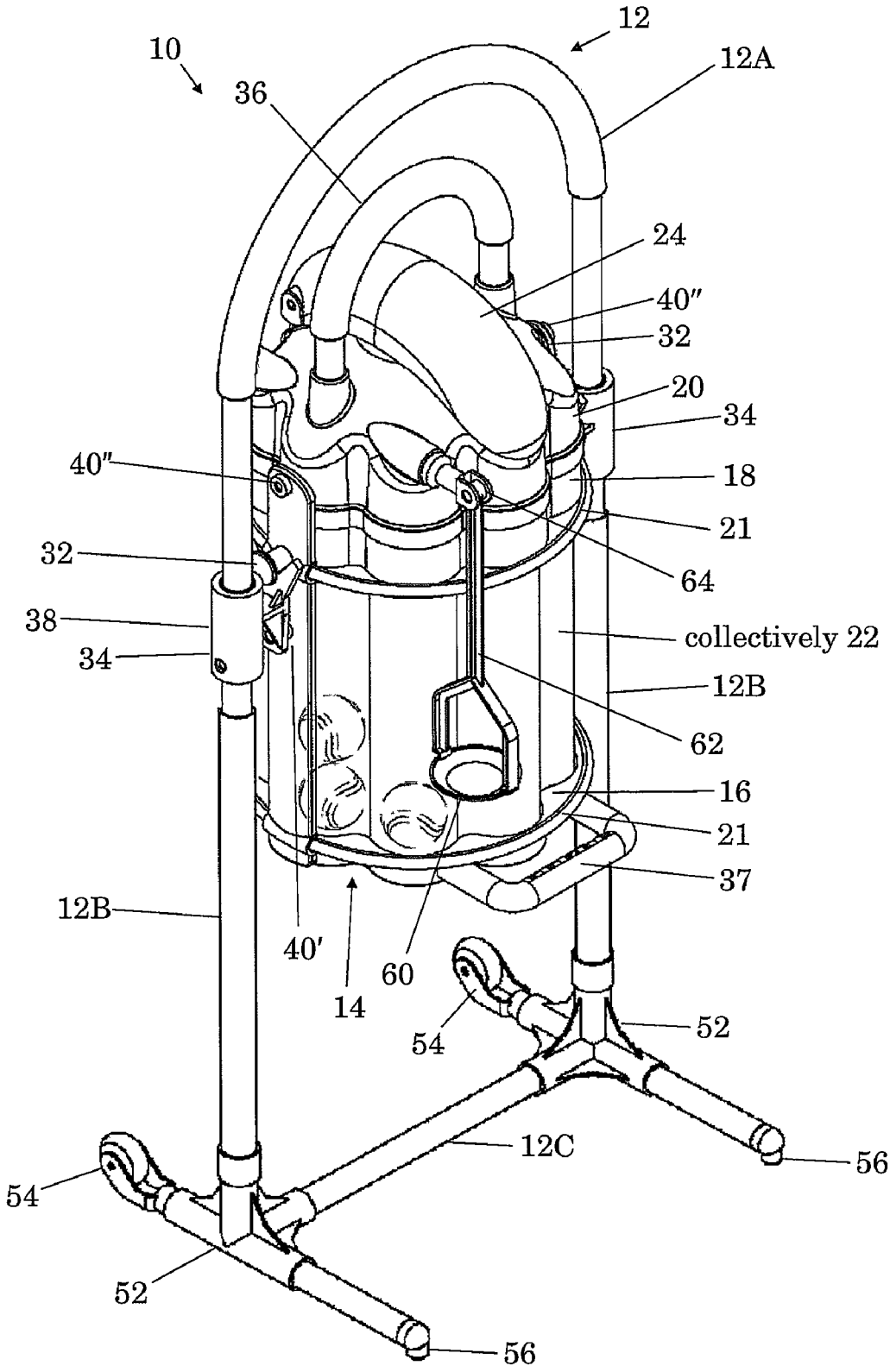
FIG. 2 is a perspective view of an embodiment of the tennis ball delivery device of the present invention illustrating the ball delivery device of the present invention with the frame partially extended and the ball carrier assembly in the ball collection orientation.

In the embodiment illustrated in FIGS. 1-8, the tennis ball carrier assembly 14 also comprises carrier plates 32 to secure the assembly 14 to brackets 34 which are affixed to upper frame section 12A. Carrier plates 32 may be secured to the tennis ball carrier assembly 14 by screws, bolts, adhesive, welds, or any other suitable fastening means. The tennis ball carrier assembly 14 can be secured to frame 12 either in the ball delivery orientation as illustrated in FIG. 1, wherein the lower carrier handle 36 is closest to the ground, or in the ball collection orientation, as illustrated in FIGS. 2 and 3, wherein the lower carrier handle 36 is pointing upward away from the ground. Note that the orientation of frame 12 illustrated in FIG. 2 is in the collapsed position, as would be desired for transporting the tennis ball delivery device 10 to and from the tennis court. The tennis ball carrier assembly 14 is illustrated in FIG. 3 in the ball collection orientation and detached from the frame 12. As is described below, the tennis ball carrier assembly 14 is used in this orientation to collect balls off the ground. Upper carrier handle 37 enables the user to easily carry the tennis ball carrier assembly 14 in the ball delivery orientation and to easily rotate the tennis ball carrier assembly 14 either into the ball delivery orientation or the ball collection orientation once tennis ball carrier assembly 14 is mounted on frame 12.

As illustrated most visibly in FIG. 3, carrier plates 32 each comprise carrier post 38 and two alignment holes 40' and 40". Alignment hole 40' is located closer to upper carrier section 16, while alignment hole 40" is located closer to lower carrier handle 36. As illustrated in FIG. 1, the user secures the tennis ball carrier device 14 to frame 12 by aligning each of the two carrier posts 38 with the receiving portion 44 of each of the two frame brackets 34. In the embodiment of the frame brackets 34 illustrated in the drawings, receiving portion 44 is defined by a v-shaped groove 44*a* in frame bracket 34. The user then slides each of the two carrier pins 46 axially through the hole in frame bracket 34 and upper frame section 12A into either alignment hole 40' or 40", depending on whether the user desires to secure the tennis ball carrier assembly 14 in the ball collection orientation as illustrated in FIG. 2, or in the ball delivery orientation as illustrated in FIG. 1. Because carrier posts 38 in this embodiment are cylindrical, the user can rotate the tennis ball carrier device 14 to either the ball delivery orientation or the ball collection orientation while the tennis ball carrier device 14 is resting on the frame brackets 34. Carrier pins 46 prevent the tennis ball carrier device 14 from rotating out of the desired orientation.

The user collects tennis balls from the surface of the court by gripping lower carrier handle 36 while tennis ball carrier assembly 14 is in the ball collection orientation (see, e.g., FIG. 2), aligning one or more of the plurality of holes 28 in upper carrier section 16 with one or more tennis balls, and pressing the upper carrier section 16 down toward the ground. Alignment fins 48 located on upper carrier section 16 help direct the tennis balls to the holes 28 to facilitate their collection. Holes 28 are slightly larger in diameter than a new tennis ball. Retainer rings 50 prevent the tennis balls from inadvertently falling through holes 28. As illustrated in FIG. 1, the two retainer rings 50 are concentric about centerline 30 and spaced apart approximately 2.25 inches, a distance slightly less than the diameter of a worn tennis ball. When the tennis ball carrier device 14 is pressed down on a tennis ball, the retainer rings 50 will cause temporary deformation of the ball so that the ball can pass between the retainer rings 50 and into ball delivery conduits 22. Retainer rings 50 can also be designed to temporarily deform as a tennis ball is forced against them. The retainer rings 50 illustrated in FIGS. 1, 4, 7, and 8, or other suitably shaped protrusions that function in the same manner as the retainer rings 50, can be integral to the upper carrier section 16 such that they are formed in the same plastic injection mold that forms the upper carrier section 16. Alternatively, retainer rings 50 can be formed separately and snapped, glued, bolted, or affixed by any other suitable mean to the upper carrier section 16. The balls and retainer rings 50 quickly return to their unstressed state and, thus, the balls will be held within the ball delivery conduits 22. More than one ball can be simultaneously collected by the tennis ball delivery device 14.

Any or all of the components comprising tennis ball carrier assembly 14 can be formed of any relatively rigid material such as aluminum, steel, or other metals or metal alloys, or of opaque or translucent plastic or fiberglass, or any combination thereof, but are preferably formed of a rigid plastic material. The ball delivery conduits 22 are preferably formed of a clear rigid plastic so that the user can see how many balls are located within each of the ball delivery conduits 22.

In the configuration of the support frame 12 illustrated in the drawings, the frame comprises upper frame section 12A, intermediary frame section 12B, lower frame section 12C, and frame brackets 34. Other frame configurations could also be employed. Preferably, however, the support frame allows the elevation of the tennis ball carrier assembly 14 in the ball delivery orientation to accommodate players of different heights and to allow the player to vary the height that the ball will bounce after being discharged to enable the player to practice different tennis strokes.

As discussed above, the tennis ball carrier assembly 14 is carried within upper frame section 12A on frame brackets 34. As illustrated in FIGS. 1 and 2, the upper frame section 12A and intermediary frame section 12B are preferably formed of hollow tubing so as to render the frame 12 relatively rigid and substantially light in weight. Upper frame section 12A is affixed to intermediary frame section 12B. A portion of the upper frame section 12A can have a foam or rubber overlay to enhance comfort and grip. The lower frame section 12C of the embodiment of the delivery device 10 illustrated in FIG. 1 is comprised of hollow tubing, frame connectors 52, frame wheels 54, and pads 56. Frame connectors 52 connect lower frame section 12C to the intermediary frame sections 12B. The components comprising lower frame section 12C can be fastened together using screws, bolts, adhesive, welds, or any other suitable fastening means. As noted above, other durable and lightweight frame constructions could be employed in frame 12 and the particular tubular structure illustrated in the drawings is merely a representative example of one of a variety of configurations that could be employed to form frame 12. Any or all of the components comprising frame 12 can be formed of any rigid, solid material such as aluminum, steel, or other metals or metal alloys, plastic, or fiberglass.

As illustrated in FIGS. 1 and 2, to permit the desired adjustability and collapsibility of the height of frame 12, the tubing of upper frame section 12A can have an outside diameter slightly less than the inner diameter of the tubing comprising intermediary frame section 12B such that upper frame section 12A can telescope out from intermediary frame section 12B. Thus, extending upper frame section 12A in an upward direction and out from the inside of intermediary frame section 12B will increase the overall height of frame 12. In this embodiment, upper frame portion 12A and/or intermediary frame portion 12B would preferably comprise locking features such as insert pins, push pins, set screws, notches, collars, or other suitable locking features to secure upper frame section 12A at the desired height relative to intermediary frame section 12B.

With the tennis ball carrier assembly 14 secured to frame 12 in the ball delivery orientation and at the desired height, the user can perform forehand or backhand tennis strokes. The user hits the ball using either a backhand or forehand stroke after the ball falls from the discharge chute 24 and bounces to a predetermined desired height. The height and velocity of the tennis ball exiting from the discharge chute 24 depends on the elevation of discharge chute 24 above the ground, and the length, angular orientation, and curvature of discharge chute 24. Accordingly, there are several ways to adjust the height of the bounce of the tennis ball to accommodate players of varying height and to enable a player to practice hitting the ball at various elevations.

First, the elevation of the bounce of the ball can be varied by adjusting the height of frame 12 as discussed above. Second, the elevation of the bounce of the ball can be varied by altering the length, angular orientation, and/or the curvature of chute 24. The angular orientation of the delivery chute 24 can be adjusted by a variety of means. First, a threaded stopper mechanism can be attached to the lower carrier section 20 such that the end of the threaded stopper mechanism contacts the end of the delivery chute 24 closest to the tabs 58. Thus, by retracting the end of the threaded stopper, the delivery chute 24 will fall open further under the force of gravity and the free end of the delivery chute 24 will be closer to the ground. By extending the head of the threaded stopper, the delivery chute 24 will not be able to open as far and the free end of the delivery chute 24 will be further from the ground. So adjusting the angular orientation of the delivery chute 24 will affect the elevation of the bounce of the tennis ball that is discharged from the chute 24. An alternative means for adjusting the angular orientation of the delivery chute 24 is as follows. Referring to FIGS. 3 and 4, connecting surfaces 57 of the delivery chute 24 and the inner surfaces of tabs 59 on lower carrier section 20 can define notches, pits, protrusions, or other similar roughening features so that the delivery chute 24 is disposed to remain in a predetermined angular orientation until the user applies a sufficient rotational force to delivery chute 24 to overcome the frictional forces caused by the notches, pits, protrusions, or other similar roughening features, causing delivery chute 24 to rotate to a different angular orientation. Thus, the notches, pits, protrusions, or other similar roughening features function as locking features holding the delivery chute 24 in the desired angular orientation. Lower carrier handle 36 can also be used to secure delivery chute 24 in the desired angular orientation. When connecting surfaces 57 of the delivery chute 24 and the inner surfaces of tabs 59 on lower carrier section 20 are smooth and the forces caused by the hardware connecting the delivery chute 24 to the tabs 59 are slight, delivery chute 24 will freely rotate about its connection point such that gravity will cause delivery chute 24 to fall open against the lower carrier handle 36 when the tennis ball carrier assembly 14 is in the ball delivery orientation. In this embodiment, the height of lower carrier handle 36 will control the angular orientation of the delivery chute 24. The height of the lower carrier handle 36 can be adjusted by pulling lower carrier handle 36 away from the lower carrier section 20. Lower carrier handle 36 can define notches, nodules, protrusions, alignment pins and holes, or other suitable locking features to secure lower carrier handle 36 at the desired height. It is to be understood, that there are other means for adjusting the elevation of the ball discharge chute 16 that could be employed in the present invention.

Each time ball release mechanism 26 is activated with the tennis ball carrier assembly 14 in the ball delivery orientation, the ball release mechanism 26 causes the tennis ball delivery device 10 to deliver one ball. In the embodiment of the invention illustrated in the drawings, the ball release mechanism 26 comprises wheel 72 and ball release cylinder 78 and is most clearly illustrated in FIGS. 4, 6, and 7. Ball release mechanism 26 is carried by the middle carrier section 18 and is concentrically located about centerline 30. Bearing 82 provides a smooth interface and reduces rotational friction between ball release mechanism 26 and middle carrier section 18. Ball release cylinder 78 is attached to wheel 72 such that, as wheel 72 turns $1/8^{th}$ of a turn, ball release cylinder 78 also turns $1/8^{th}$ of a turn. Ball release cylinder 78 aligns with the end of one of the eight ball delivery conduits 22 comprising the embodiment of the tennis ball carrier assembly 14 illustrated in FIGS. 1-8 each time the activating mechanism 27 is triggered. When this occurs, i.e., when ball release cylinder 78 aligns with the end of one of the eight ball delivery conduits 22, one tennis ball in the aligned delivery conduit falls through opening 80 in ball release cylinder 78 under the force of gravity. Ball release mechanism 26 may comprise a coil spring, torsion spring, or any other suitable biasing means to cause wheel 72 to apply a sufficient counteracting force against lever 70 to ensure that rod 66 returns to its pre-force position after ball release mechanism 26 has been activated. This, in turn, will ensure that the ball release mechanism 26 has advanced $1/8^{th}$ with sufficient precision to ensure that the ball release mechanism is sufficiently aligned with one of the array of ball delivery conduits 22 and that the lowest positioned tennis ball in that conduit can fall through the opening 80 in ball release cylinder 78 under the force of gravity without obstruction.

As discussed above, the ball release mechanism 26 can be manually activated to reduce costs and to permit the operation of the tennis ball delivery device 10 without the need for electricity. In the embodiment of the activating mechanism 27 illustrated in FIGS. 1-8, the activating mechanism 27 is housed in lower carrier section 20 and comprises disk 60, arm 62, hinge 64, rod 66, seal 68, lever 70, lever hinge 72, and spring 74. Arm 62 rotates about hinge 64. Arm 62 and hinge 64 comprise elements such as protrusions or stopper screws that limit the range of rotation of arm 62 with respect to rod 66 so that, when the tennis ball carrier assembly 14 is in the ball delivery orientation as illustrated in FIG. 1, arm 62 rotates under the force of gravity to an approximately horizontal orientation, but no further. When the tennis ball carrier assembly 14 is in the carrying orientation, as illustrated in FIG. 2, arm 62 falls under the force of gravity to an approximately vertical orientation.

When the ball carrier assembly 14 is in the ball delivery orientation as illustrated in FIG. 1, the user of the tennis ball delivery device 10 releases a single tennis ball by exerting a preferably approximately horizontal force against the activating mechanism 27. This can be done by pushing the end of a tennis racket against disk 60. Disk 60 is attached to arm 62, and arm 62 is attached to rod 66 at hinge 64. Rod 66 passes through a hole in lower carrier section 20. The hole in lower carrier section 20 is sealed by seal 68. Thus, when an approximately axial force is applied to disk 60, arm 62 pushes rod 66 in its axial direction, causing lever 70 to turn the release mechanism 27, comprising wheel 72 and ball release cylinder 78, $1/8^{th}$ of a turn.

Spring 74 causes rod 66 to return to its initial, pre-force position. Lower carrier section 20 comprises protrusions or other features that stop rod 66 in its pre-force position. Lever 70 is positioned within the longitudinal slot 77 through the middle of rod 66 and is attached to rod 66 by lever hinge 76. Slot 77 is most clearly illustrated in FIGS. 6 and 8. Lever hinge 76 preferably comprises a coil spring, torsion spring, or any other suitable biasing means that would cause the lever 70 to always be in contact with wheel 72. Disk 60 can be formed of soft, pliable rubber and/or contain features such as raised rubber nodules to improve the contact grip between the end of the user's tennis racket and the disk 60 and, hence, prevent the user's tennis racket from inadvertently slipping off of the disk 60. Deformation of the soft, rubber disk 60 in response to the force caused by the end of the user's racket will also improve the contact grip. Furthermore, the surface of disk 60 can be concave or similarly shaped to approximately match the curvature of the end of a typical tennis racket.

Each time a ball in the ball delivery conduit 22 is released, all of the remaining balls in the same ball delivery conduit 22 will advance one spot, i.e., a distance equal to the diameter of one ball. Ball release cylinder 78 defines a protrusion 84. Protrusion 84, which is approximately the width of one tennis ball, prevents more than one tennis ball from passing through opening 80 at one time by obstructing the pathway of the next successive tennis ball in the ball delivery conduit 22. After passing through opening 80, the tennis ball then passes through the opening in the center of wheel 72 and then the opening in the center of lower carrier section 20. The tennis ball then falls into discharge chute 24, which discharges the tennis ball at a predetermined height, as discussed above, to be hit by the player.

Alternatively, the release of tennis balls from the tennis ball carrier assembly 14 in the ball delivery orientation can be automatically activated to eliminate the need for a player to physically strike the ball release disk 60 as in the prior embodiments. An automatic activator would replace the disk 60, arm 62, hinge 64, rod 66, seal 68, and spring 74. An automatic actuator could be in the form of a battery operated solenoid that, when triggered, would cause the opening 80 in the ball release mechanism 26 to advance to the next ball delivery conduit 22 by exerting a force through lever 70 on wheel 72. The triggering switch to trigger the automatic actuator could be a conventional timer such as those employed in ball pitching machines and could allow the user to set the frequency of the ball drop, i.e., interval of the rotation of the wheel 72. Such a timer would allow the user to rhythmically practice his or her strokes by providing a constant time duration between the dropping of each ball. Alternatively, the triggering switch could comprise a motion detector activated by the user swinging his or her racket in front of the emitting end of such a device. Such a detector could be of any suitable type such as a photo sensor, a capacitance activated detector or a remote control activation device.

The ball delivery device 10 also may employ a vibrator to assist in maintaining a continuous passage of tennis balls through the ball delivery conduits 22. Various other changes and modifications may be made in carrying out the present invention without departing from the spirit and scope thereof.

What is claimed is:

1. A tennis ball delivery device for use in practicing one's tennis stroke, said device comprising a frame and a tennis ball carrier assembly, said assembly comprising a plurality of ball delivery conduits, each of said conduits being adapted to receive one or more tennis balls therein, a ball discharge chute, a ball release mechanism operatively connected with said conduits so as to allow a single ball to fall from one of said plurality of ball delivery conduits onto said ball delivery chute in response to activation of said release mechanism, and means for actuating said ball release mechanism.

2. The tennis ball delivery device of claim 1 wherein said ball delivery conduits each comprise a hollow cylinder defining an inner diameter of sufficient size to permit a tennis ball to pass therethrough and wherein said cylinders are disposed in a substantially vertical disposition in said assembly.

3. The tennis ball delivery device of claim 1 wherein said ball delivery conduits are disposed in a parallel vertical array.

4. The tennis ball delivery device of claim 1 wherein said ball release mechanism comprises a moveable member, said member being disposed below and obstructing all but one of said ball delivery conduits, said member being operatively connected to said actuating means such that activation of said means effects movement of said member so as to successively vary said one of said ball delivery conduits, said member being operatively connected to said actuating means such that activation of said means effects movement of said member so as to successively vary said on of said ball delivery conduits whereby all of said conduits are selectively and individually communicated with said discharge chute upon repeated activation of said means.

5. The tennis ball delivery device of claim 4 wherein said ball release mechanism includes a plurality of engagement members and said actuation means comprises an axially translatable elongated member operatively connected to at least one of said engagement members and positioned to be axially translated by a tennis racket during the practice of one's tennis stroke whereby repeated axial translation of said elongated member effects repeated incremental movement of said moveable member and successive communication of one of said ball delivery conduits with said ball discharge chute through said aperture.

6. The tennis ball delivery device of claim 4 wherein said ball release mechanism comprises a stop member to prevent more than one ball from passing through said ball release mechanism each time said ball release mechanism is activated.

7. The tennis ball delivery device of claim 1 wherein said ball release mechanism comprises a rotatable member defining an aperture therein, said aperture being sized to allow a tennis ball to pass therethrough and being successively axially alignable with each of said ball delivery conduits upon rotation of said member with respect to said conduits and wherein said actuation means effects rotation of said member.

8. The tennis ball delivery device of claim 7 wherein said rotatable member rotates such that said aperture therein is moved into alignment with another of said ball delivery conduits each actuation of said ball release mechanism.

9. The tennis ball delivery device of claim 7 wherein said ball release mechanism includes a plurality of engagement members and said actuation means comprises an axially translatable elongated member operatively connected to at least one of said engagement members and positioned to be axially translated by a tennis racket during the practice of one's tennis stroke whereby repeated axial translation of said elongated member effects repeated incremental rotation of said moveable member and successive communication of one of said ball delivery conduits with said ball discharge chute through said aperture.

10. The tennis ball delivery device of claim 7 wherein said ball release mechanism includes a stop member for preventing more than one ball from passing through said one of said plurality of ball delivery conduits upon each actuation of said ball release mechanism.

11. The tennis ball delivery device of claim 1 wherein said ball release mechanism comprises a moveable member defining an aperture therein sized to allow a tennis ball to pass therethrough, said member being disposed below and obstructing all but one of said tennis ball delivery conduits, said member being operatively connected to said actuating means such that activation of said means effects movement of said member from a position wherein said aperture is in alignment with one of said ball delivery conduits to another position wherein said aperture is in alignment with another of said ball delivery conduits whereby all of said conduits are selectively and individually aligned with said aperture and communicated with said chute upon repeated activation of said actuation means.

12. The tennis ball delivery device of claim 1 wherein said tennis ball carrier assembly includes means for varying the vertical elevation of said ball discharge chute whereby one can vary the elevation of the bounce of a ball discharged from said chute.

13. The tennis ball delivery device of claim 1 wherein said tennis ball carrier assembly is moveably mounted on said frame such that the elevation of said ball discharge chute can be selectively varied whereby one can vary the elevation of the bounce of a ball discharged from said chute.

14. The tennis ball delivery device of claim 1 said tennis ball carrier assembly is removably attachable to said frame and includes an upper portion and a lower portion, said ball delivery conduits being disposed between said upper and lower portions, said ball discharge chute being carried by said lower portion and communicating with a lower end portion of one of said ball delivery conduits and including a plurality of ball collection members carried by said upper portion of said ball carrier assembly proximate upper end portions of said ball delivery conduits whereby upon detaching said ball carrier assembly from said frame, inverting said assembly and pressing said assembly downwardly against one or more tennis balls, said ball or balls are directed into and retained within one or more of said conduits by one or more of said ball collection members.

15. The tennis ball delivery device of claim 14 wherein said ball collection members are configured so as to partially occlude the upper end portions of said conduits such that upon being pressed against one or more balls, said collection members will temporarily deform said one or more balls enabling the ball or balls to pass thereby and be retained within one or more of said conduits.

16. The tennis ball delivery device of claim 14 wherein said ball collection members are resilient and deformable, one or more of said members being disposed adjacent upper end portions of each of said ball delivery conduits.

17. The tennis ball delivery device of claim 14 including a handle member carried by said lower portion of said ball carrier assembly for carrying said assembly in an inverted disposition upon said assembly being detached from said frame.

18. The tennis ball delivery device of claim 17 wherein said handle defines a stop limiting the angular orientation of said discharge chute.

19. The tennis ball delivery device of claim 14 wherein said ball release mechanism comprises a moveable member, said member being disposed below and obstructing all but one of said ball delivery conduits, said member being operatively connected to said actuating means such that activation of said means effects movement of said member so as to successively vary said one of said ball delivery conduits whereby all of said conduits are selectively and individually communicated with said discharge chute upon repeated activation of said means.

20. The tennis ball delivery device of claim 19 wherein said ball release mechanism includes a plurality of engagement members and said actuation means comprises an axially translatable elongated member operatively connected to at least one of said engagement members and positioned to be axially translated by a tennis racket during the practice of one's tennis stroke whereby repeated axial translation of said elongated member effects repeated incremental rotation of said moveable member and successive communication of one of said ball delivery conduits with said ball discharge chute through said aperture.

21. The tennis ball delivery device of claim 14 wherein said ball release mechanism comprises a rotatable member defining an aperture therein, said aperture being sized to allow a tennis ball to pass therethrough and being successively axially alignable with each of said ball delivery conduits upon rotation of said member with respect to said conduits and wherein said actuation means effects rotation of said member.

22. A tennis ball delivery device for use in practicing one's tennis stroke, said device comprising a frame, a tennis ball carrier assembly carried by said frame, said assembly comprising a plurality of ball delivery conduits each of said conduits being adapted to receive one or more tennis balls therein, a ball discharge chute, a ball release mechanism comprising a moveable member disposed below and obstructing all but one of said ball delivery conduits and an actuating member operatively connected to said moveable member such that activation of said actuating member effects movement of said moveable member so as to successively vary said one of said ball delivery conduits whereby all of said conduits are selectively and individually communicated with said discharge chute upon repeated activation of said actuating member.

23. The tennis ball delivery device of claim 22 wherein said ball delivery conduits each comprise a hollow cylinder defining an inner diameter of sufficient size to permit a tennis ball to pass therethrough and wherein said cylinders are disposed in a substantially vertical disposition in said assembly.

24. The tennis ball delivery device of claim 23 wherein said ball delivery conduits are disposed in a parallel vertical array.

25. The tennis ball delivery device of claim 22 wherein said ball release mechanism additionally includes a plurality of engagement members and said actuating member is operatively connected to at least one of said engagement members and positioned so as to be axially translatable by a tennis racket during the practice of one's tennis stroke whereby repeated axial translation of said actuating member effects repeated incremental movement of said moveable member and successive communication of another of said ball delivery conduits with said ball discharge chute through said aperture.

26. The tennis ball delivery device of claim 22 wherein said tennis ball carrier assembly includes means for varying the vertical elevation of said ball discharge chute whereby one can vary the elevation of the bounce of a ball discharged from said chute.

27. The tennis ball delivery device of claim 22 wherein said tennis ball carrier assembly is moveably mounted on said frame such that the elevation of said ball discharge chute can be selectively varied whereby one can vary the elevation of the bounce of a ball discharged from said chute.

28. The tennis ball delivery device of claim 22 wherein said tennis ball carrier assembly is removably attachable to said frame and includes an upper portion and a lower portion, said ball delivery conduits being disposed between said upper and lower portions, said ball discharge chute being carried by said lower portion and selectively communicating with a lower end portion of one of said ball delivery conduits and including a plurality of ball collection members carried by said upper portion of said ball carrier assembly proximate upper end portions of said ball delivery conduits whereby upon detaching said ball carrier assembly from said frame, inverting said assembly and pressing said assembly downwardly against one or more tennis balls, said ball or balls are directed into and retained within one or more of said conduits by one or more of said ball collection members.

29. The tennis ball delivery device of claim 28 wherein said ball release mechanism includes a stop member for preventing more than one ball from passing through said one of said plurality of delivery conduits upon each actuation of said ball release mechanism.

30. The tennis ball delivery device of claim 28 wherein said ball collection members are configured so as to partially occlude the upper end portions of said conduits such that upon being pressed against one or more balls, said collection members will temporarily deform said one or more balls enabling the ball or balls to pass thereby and be retained within one or more of said conduits.

31. The tennis ball delivery device of claim 22 wherein said ball release mechanism comprises a rotatable member defining an aperture therein, said aperture being sized to allow a tennis ball to pass therethrough and being successively axially alignable with each of said ball delivery conduits upon rotation of said member with respect to said conduits and wherein said actuation means effects rotation of said member.

32. The tennis ball delivery device of claim 31 wherein said rotatable member rotates such that said aperture therein is moved into alignment with another of said ball delivery conduits with each actuation of said ball release mechanism.

33. The tennis ball delivery device of claim 31 wherein said ball release mechanism includes a plurality of engagement members and said actuation means comprises an axially translatable elongated member operatively connected to at least one of said engagement members and positioned to be axially translated by a tennis racket during the practice of one's tennis stroke whereby repeated axial translation of said elongated member effects repeated incremental movement of said moveable member and successive communication of one of said ball delivery conduits with said ball discharge chute through said aperture.

34. The tennis ball delivery device of claim 31 wherein said ball release mechanism includes a stop member for preventing more than one ball from passing through said one of said plurality of ball delivery conduits upon each actuation of said ball release mechanism.

* * * * *